US006212468B1

(12) United States Patent
Nakayama et al.

(10) Patent No.: US 6,212,468 B1
(45) Date of Patent: Apr. 3, 2001

(54) SYSTEM FOR OPTICALLY DETECTING VEHICLES TRAVELING ALONG THE LANES OF A ROAD

(75) Inventors: Hiroyuki Nakayama; Riichiro Yamashita; Masayoshi Konishi, all of Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/023,709

(22) Filed: Feb. 13, 1998

(30) Foreign Application Priority Data

May 29, 1997 (JP) ..... 9-140112

(51) Int. Cl.[7] ..... G08G 1/01

(52) U.S. Cl. ..... 701/117; 701/116; 340/933; 340/937; 340/942

(58) Field of Search ..... 701/117, 116; 340/937, 933, 942

(56) References Cited

U.S. PATENT DOCUMENTS

| | | | | |
|---|---|---|---|---|
| 5,392,034 | * | 2/1995 | Kuwagaki | 340/937 |
| 5,554,984 | * | 9/1996 | Shigenaga et al. | 340/937 |
| 5,602,375 | * | 2/1997 | Sunahara et al. | 235/384 |
| 5,726,450 | * | 3/1998 | Peterson et al. | 250/338.5 |

FOREIGN PATENT DOCUMENTS

| | | |
|---|---|---|
| 2557185 | 7/1976 | (DE) . |
| 4234548 | 9/1993 | (DE) . |
| 0789342 | 8/1997 | (EP) . |
| 8044994 | 2/1996 | (JP) . |
| 8055293 | 2/1996 | (JP) . |
| 8055295 | 2/1996 | (JP) . |
| 8235487 | 9/1996 | (JP) . |
| 8235488 | 9/1996 | (JP) . |

OTHER PUBLICATIONS

Patent Abstracts of Japan, 07 244796, Sep. 19, 1995.
Patent Abstracts of Japan, 08 055293, Feb. 27, 1996.
Patent Abstracts of Japan, 08 055295, Feb. 27, 1996.
Patent Abstracts of Japan, 63 292068, Nov. 29, 1988.

* cited by examiner

*Primary Examiner*—William A. Cuchlinski, Jr.
*Assistant Examiner*—Tuan To

(57) ABSTRACT

A system for optically detecting vehicles traveling a road having a plurality lanes. The system includes a gantry provided at the road so as to straddle the plurality lanes. There are a plurality of optical line sensors provided on the gantry, for obtaining linear images of a surface of the road. There are optical line sensors arranged in two rows and in a staggered pattern such that each has a view field overlapping the view field of either adjacent optical line sensor by the sum of half the view field and a width of a motor cycle, photoelectric sensor apparatus consisting of photo-projector elements and photo-detector elements and optical axes which are parallel to each other and are substantially located in the position of the view field of the optical line sensors. There is a signal-processing section for detecting a vehicle traveling under the gantry in accordance with output signals of the optical line sensors and output signals of the photo-electric sensor apparatus, by using reference signals which the optical line sensors generate when no vehicles travel under them.

5 Claims, 5 Drawing Sheets

SYSTEM FOR OPTICALLY DETECTING VEHICLES TRAVELING ALONG THE LANES OF A ROAD

BACKGROUND OF THE INVENTION

The present invention relates to a system for detecting vehicles traveling along a plurality of lanes of a toll road.

In order to collect toll automatically at a tollgate to a toll road, it is necessary to detect any vehicle coming to or passing through the tollgate.

A vehicle detecting system is known which optically detects vehicles passing along the lanes of a toll road. As shown in FIG. 1, the system comprises a gantry 2 and a plurality of optical line sensors 3*a* to 3*g*. The gantry 2 straddles the toll road 1, extending across the 3-lane toll road 1. The line sensors 3*a* to 3*g* are attached to the lower side of the gantry 2. The sensors 3*a* is located above the outer boundary of the lane 4*a*, the sensor 3*c* above the boundary between the lanes 4*a* and 4*b*, the sensor 3*e* above the boundary between the lanes 4*b* and 4*c*, and the sensor 3*g* above the outer boundary of the lane 4*c*. The sensors 3*b*, 3*d* and 3*f* are located above the center lines of the lanes 4*a*, 4*b* and 4*c*, respectively. On the surface of the road 1, the view field 3*x* of each line sensor overlaps half the view field 3*x* of either adjacent sensor.

When no vehicles are under the gantry 2, the line sensors 3*a* to 3*g* get the linear images of the surface of the road 1 at the right angle to the direction of the lanes and convert the linear images into video signals respectively. The video signals are stored in a memory device, so that the signals may be used as reference signals. In this case, above the line sensors can use one dimensional type TV cameras, as well as projecting/receiving light type sensors emitting and scanning light beam.

In operation, the line sensors 3*a* to 3*g* get the linear images of the surface of the road 1, and convert them into video signals. These signals are compared with the reference signals to determine whether or not vehicles are on the toll road 1. Assume a vehicle 5 is on the second lane 4*b* as shown in FIG. 2. In this case, the signal generated by the sensor 3*d* located above the center line of the second lane 4*b* and the signals generated by the sensors 3*c* and 3*e* located on the sides of the sensor 3*d* are compared with the three reference signals generated by the sensors 3*d*, 3*c* and 3*e*. The basis of the difference between each signal and the corresponding reference signal is used to detect the vehicle 5. In FIG. 2, S1, S2 and S3 represent the diagrammatically the signal differing sections where the signals generated by the line sensors 3*c*, 3*e* and 3*d* differ from the corresponding reference signals, respectively. The signal the sensor 3*d* generates when the vehicle 5 goes right below the sensor 3*d* has a signal differing section which is wider than the section representing the width of the vehicle 5. By contrast, the signals the sensors 3*c* and 3*e* generate when the vehicle 5 travels right below the sensor 3*d* have a signal differing section which is just about half the section representing the width of the vehicle 5. This is because the view fields 3*x* of the sensors 3*c* and 3*e* each overlap half the view field 3*x* of the sensor 3*d* on the surface of the road 1 and get the image of the vehicle 5 sideways. Hence, the width 6 of the vehicle 5 can be detected from a logical product of the signal differing sections S1, S2 and the signal differing section S3.

Unless the width 6 of the vehicle 5 is extremely small, it can be accurately detected a logical product of the signal differing sections S1, S2 and the section S3. Even the width of a motorcycle, which is relatively small, can be accurately detected unless the motorcycle is located right below any one of the line sensors 3*a* to 3*g*.

But the conventional vehicle-detecting system may fail to detect a motor cycle, when a motorcycle 5*a* is traveling, almost along the center line of the lane 4*b* as is illustrated in FIG. 3, or virtually along the boundary between the view fields of the line sensors 3*c* and 3*e*. If this is the case, the signal differing section S3 of the signal generated by the sensor 3*d* is large, but the sections S1 and S2 are very small since the widths of signal 7 detecting a motorcycle 5*a* by the sensors 3*c* and 3*e* are small. Consequently, the width 6 determined by processing the signals is therefore less than the actual width of the motor cycle 5*a*, or the motor cycle 5*a* may not be detected.

The system shown in FIG. 1 may detects fallen leaves, trash or the like, which happen to be on the toll road 1. In this case, the system generates and supplies a vehicle-detection signal, though no vehicles are passing under the gantry 2. The vehicle-detecting system has but a low operating reliability.

Earth or sand may fall from a damp track onto the road 1 and may spread over the surface of the road 1. The vehicle-detecting system detects the earth or sand and generates a false vehicle-detection signal. In view of this, too, the reliability of the conventional vehicle-detecting system is insufficient.

BRIEF SUMMARY OF THE INVENTION

The object of the present invention is to provide a vehicle-detecting system which can accurately measure the width of a vehicle, however slim the vehicle is, and which generates no false vehicle-detection signal when it detects a small thing on the road, such as a fallen leaf or trash, or a thing spread over the road, such as earth or sand, and which therefore has high operating reliability.

The foregoing object is accomplished by providing a system for optically detecting vehicles traveling a road having a plurality lanes, the system comprising:

- a gantry provide at the road so as to straddle the plurality lanes;
- a plurality of optical line sensors provided on the gantry, for getting linear images of a surface of the road, the optical line sensors arranged in two rows and in a staggered pattern such that each has a view field overlapping the view filed of either adjacent optical line sensor by the sum of half the view field and a width of a motor cycle;
- photoelectric sensor apparatus consisting of photo-projector elements and photo-detector elements, and having optical axes which are parallel to each other and are substantially located in the position of the view fields of the optical line sensors; and
- a signal-processing section for detecting a vehicle traveling under the gantry in accordance with output signals of the optical line sensors and output signals of the photoelectric sensor apparatus, by using reference signals which the optical line sensors generate when no vehicles travel under them.

With the present invention can provide the system, wherein the signal-processing section includes means for converting a correlation between the output signal of each optical line sensor and the corresponding reference signal into a binary signal, obtaining a logical sum of the binary signals pertaining to the optical line sensors of one row and a logical sum of the binary signals pertaining to the optical line sensors of the other row, obtaining a logical produce of the two logical sums, and determining, from the logical product, whether a vehicle is traveling under the gantry.

With the present invention can provide the system, wherein the signal-processing section includes means for converting a correlation between the output signal of each optical line sensor and the corresponding reference signal into a binary signal, obtaining a logical sum of the binary signals pertaining to the optical line sensors of one row and a logical sum of the binary signals pertaining to the optical line sensors of the other row, for obtaining a logical produce of the two logical sums, thereby generating a vehicle detection signal, and detecting a vehicle on the basis of the vehicle detection signal and vehicle detection signals generated by the photoelectric sensors.

With the present invention can provide the system, wherein the signal-processing section includes means for updating the reference signals to the output signals of the optical line sensors, which indicate that no vehicles are traveling under the gantry.

With the present invention can provide the system, further comprising a ticket-issuing machine for issuing a toll ticket when the signal-processing section detects a vehicle traveling under the gantry.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A vehicle-detecting apparatus according to the present invention will be described, with reference to the accompanying drawings.

Figure 4:
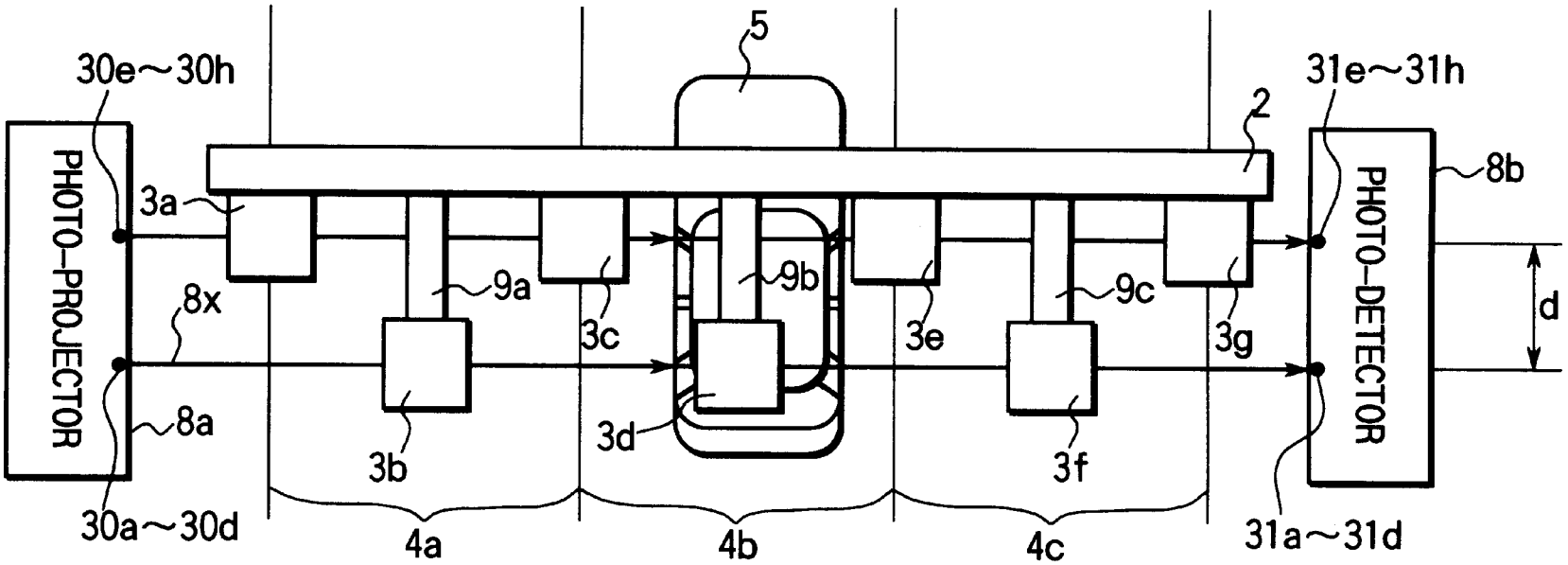
FIG. 4 is a plan view of a vehicle-detecting system according to an embodiment of the present invention.
Figure 5B:
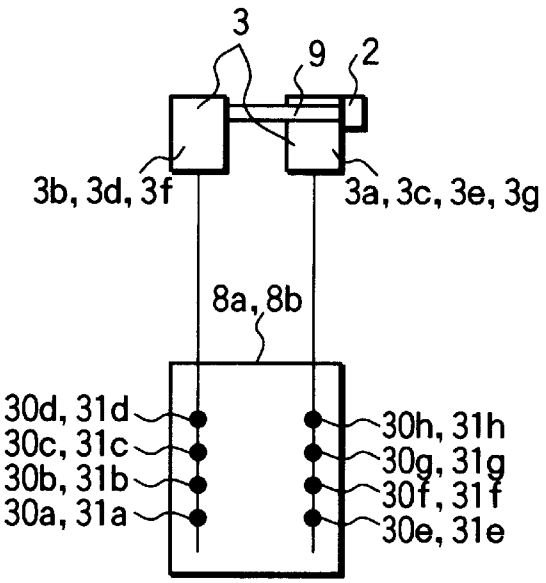
FIG. 5B is a side view of the system illustrated in FIG. 4.
Figure 5A:
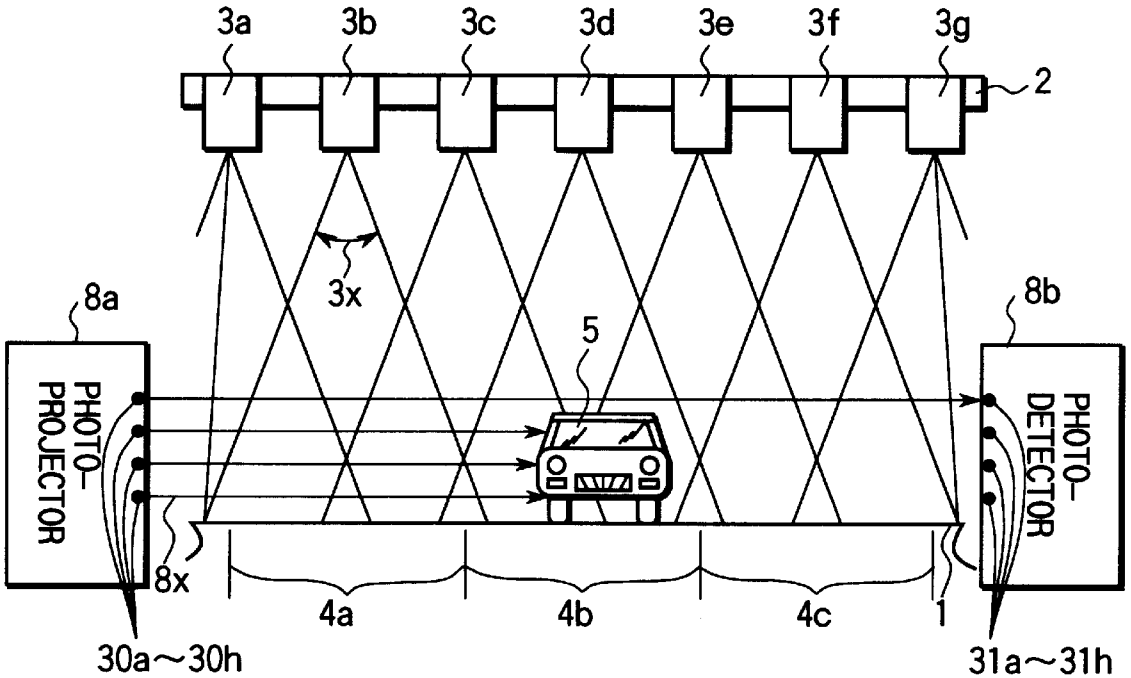
FIG. 5A is a front view of the system shown in FIG. 4.

As shown in FIGS. 4, 5A and 5B, the vehicle-detecting system comprises a gantry 2, seven optical line sensors 3*a* to 3*g*, a photo-projector 8*a* having a plurality of photo-projector elements of photoelectric sensor 30*a*, 30*b*, 30*c*, 30*d*, 30*e*, 30*f*, 30*g* and 30*h* and a photo-detector 8*b* having a plurality of photo-detector elements of photoelectric sensor 31*a*, 31*b*, 31*c* and 31*d*, 31*e*, 31*f*, 31*g* and 31*h*. The gantry 2 straddles a 3-lanes toll road 1, extending across the road 1. Above photo-projector 8*a* and photo-detector 8*b* constitute a photoelectric sensor apparatus 8.

As shown in FIG. 4 which is a plan view, the line sensors 3*a*, 3*c*, 3*e* and 3*g* are attached to one side of the gantry 2, while the line sensors 3*b*, 3*d* and 3*f* are coupled to the same side of the gantry 2 by the supports 9*a*, 9*b* and 9*c*. The sensors 3*b*, 3*d* and 3*f* are positioned in front of the sensors 3*a*, 3*c*, 3*e* and 3*g*, spaced apart therefrom by a distance d. Hence, the optical line sensors 3*a* to 3*g* are arranged in a staggered pattern as the system is viewed from above.

As shown in FIG. 5A which is a front view, the sensor 3*a* is located above the outer boundary of the lane 4*a*, the sensor 3*c* above the boundary between the lanes 4*a* and 4*b*, the sensor 3*e* above the boundary between the lanes 4*b* and 4*c*, and the sensor 3*g* above the outer boundary of the lane 4*c*. The sensors 3*b*, 3*d* and 3*f* are located above the center lines of the lanes 4*a*, 4*b* and 4*c*, respectively. On the surface of the road 1, the view field 3*x* of each line sensor overlaps that of either adjacent line sensor by the sum of half the view field 3*x* and the width of a motor cycle.

As FIG. 5A shows, the photo-projector 8*a* is provided at one side of the road 1, and the photo-detector 8*b* at the other side of the road 1. Each photo-projector elements 30*a*, 30*b*, 30*c*, 30*d*, 30*e*, 30*f*, 30*g* and 30*h* opposes one photo-detector elements 31*a*, 31*b*, 31*c*, 31*d*, 31*e*, 31*f*, 31*g* and 31*h*, across the lanes 4*a*, 4*b* and 4*c*. The elements 30*a*, 30*b*, 30*c*, 30*d*, 30*e*, 30*f*, 30*g* and 30*h* emit light beams 8*x* toward the photo-detector elements 31*a*, 31*b*, 31*c*, 31*d*, 31*e*, 31*f*, 31*g* and 31*h*, respectively. The light beams 8*x* intersect with the optical axes of the optical line sensors 3*a* to 3*g*.

As illustrated in FIG. 5B, the photo-projector elements 30*a* to 30*h* of the photo-projector 8*a* are arranged in two columns, one aligned with the optical axes of the sensors 3*a*, 3*c*, 3*e* and 3*g*, and the other aligned with the optical axes of the sensors 3*b*, 3*d* and 3*f*. The photo-detector elements 31*a*, 31*b*, 31*c*, 31*d*, 31*e*, 31*f*, 31*g* and 31*h* are arranged in the same way as the photo-projector elements 30*a*, 30*b*, 30*c*, 30*d*, 30*e*, 30*f*, 30*g* and 30*h*. Since the elements 30*a* to 30*h* and 31*a* to 31*h* are arranged in vertical columns, they serve to detect the bumpers of a car and the rearview mirrors of a heavy-duty vehicle.

Figure 6:
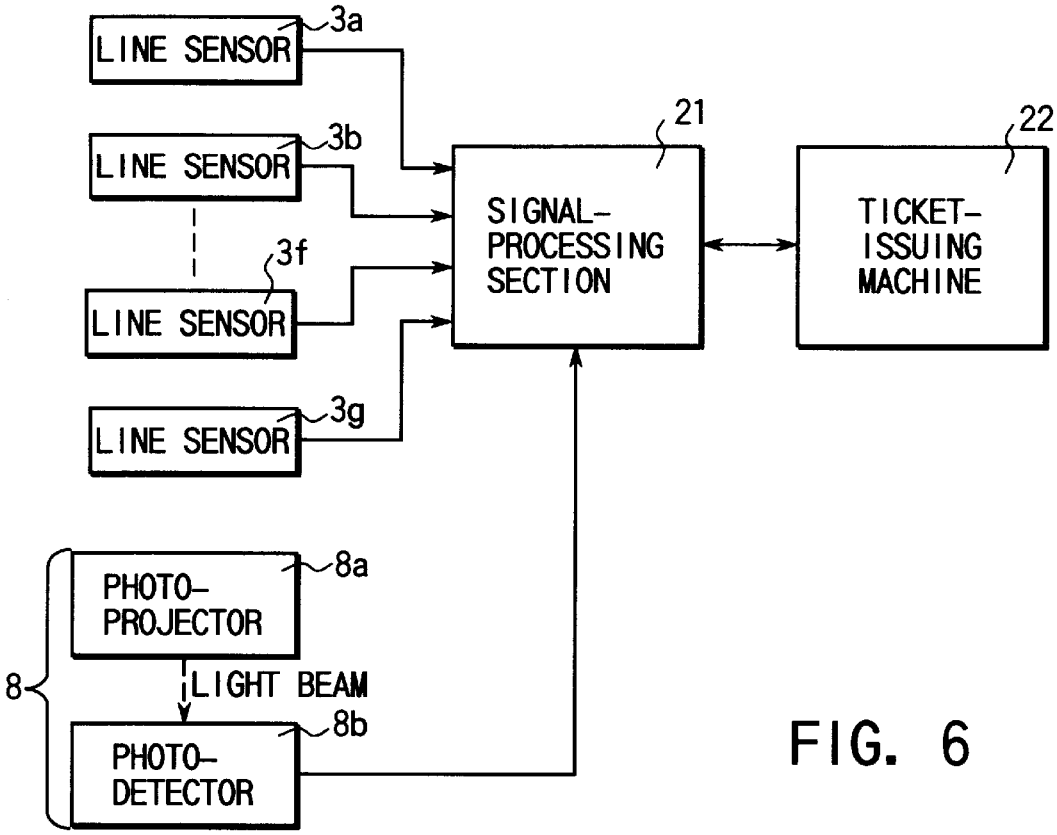
FIG. 6 is a block diagram depicting the signal-processing system incorporated in the vehicle-detecting system of FIG. 4.

As shown in FIG. 6, the optical line sensors 3*a* to 3*g* and the photoelectric sensor apparatus 8, comprising of a photo-projector 8*a* and a photo-detector 8*b*, are connected to a signal-processing section 21, which is connected to a ticket-issuing machine 22 installed at a tollgate. The section 21 processes the signals generated by the sensors, generating data representing the image of the vehicle 5*a*. The data is supplied to the ticket machine 22. The machine 22 prints a ticket on the basis of the data and issues the ticket.

Figure 7:
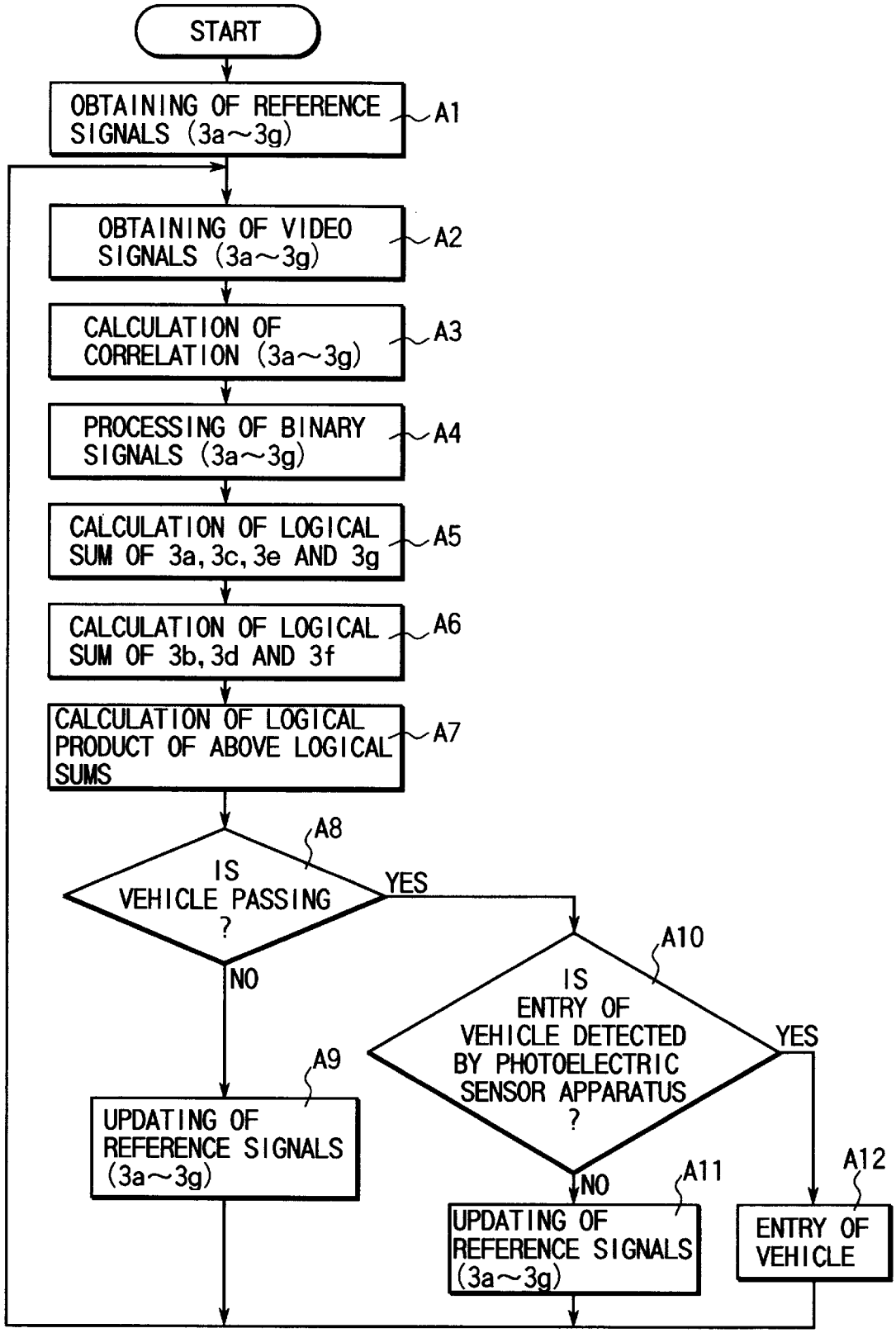
FIG. 7 is a flow chart explaining the operation of the system shown in FIG. 4.

How the vehicle-detecting system described above operates will be described with reference to the flow chart of FIG. 7.

At the start-up of system, the optical line sensors 3*a* to 3*g* get linear images of the surface of the toll road 1 just under of them. The video signals of above linear images represent the condition of the road 1 when no vehicles are traveling in the view fields of all the line sensors 3*a* to 3*g*. The video signals are supplied to the signal-processing section 21 and stored therein as reference signals (Step A1).

Once the system is put into service, the optical line sensors 3*a* to 3*g* get the linear images of the surface of the road 1 and vehicles, if any, passing under the line sensors 3*a* to 3*g*. The video signals are supplied to the signal-processing section 21 (Step A2). The section 21 compares the signals with the reference signals, thereby obtaining the correlation between each video signal and the reference signal generated by the same line sensor (Step A3).

Further, the correlation between each video signal and the reference signal is compared with a predetermined threshold value. The correlation is converted to a binary signal "1" if it is less than the threshold value, and converted to a binary signal "0" if it is equal to or greater than the threshold value (Step A4). The threshold value has been determined from two factors. The first factor is the stability of the video signals representing the condition of the road 1, and the second factor is the change which each video signal undergoes when a vehicle passes under the line sensor.

Next, a logical sum of four binary signals pertaining to the video signals generated by the line sensors 3*a*, 3*c*, 3*e* and 3*g* is obtained (Step A5). Further, a logical sum of three binary signals pertaining to the video signals generated by the line sensors 3*b*, 3*d* and 3*f* is obtained (Step A6).

Figure 1:
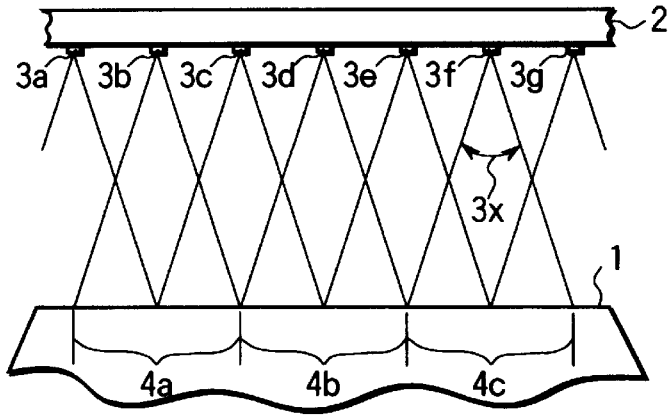
FIG. 1 PRIOR ART
FIG. 1 is a diagram showing a conventional vehicle-detecting system.
Figure 2:
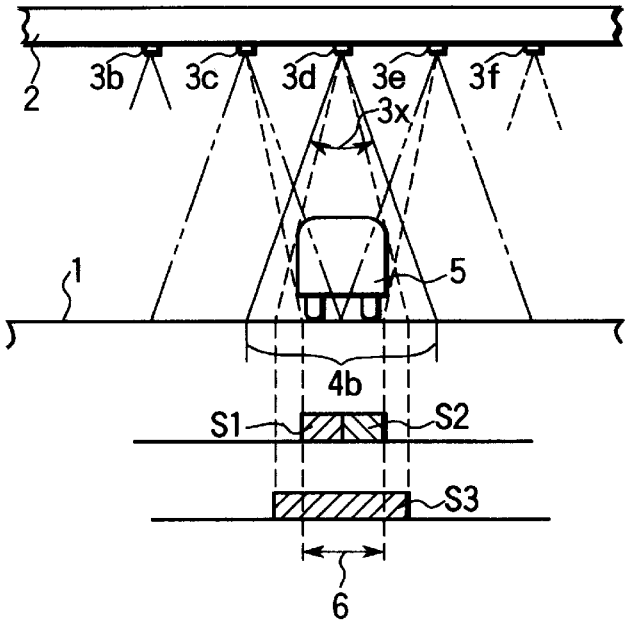
FIG. 2 PRIOR ART
FIG. 2 is a diagram explaining how the system of FIG. 1 detects a vehicle traveling on a lane of a toll road.
Figure 3:
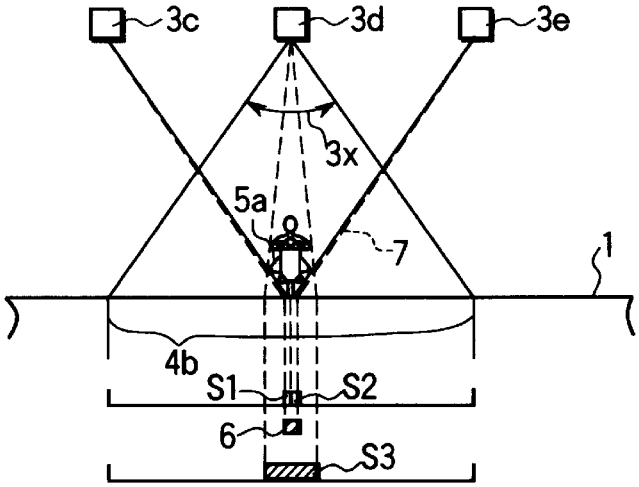
FIG. 3 PRIOR ART
FIG. 3 is a diagram explaining how the system of FIG. 1 detects a motorcycle traveling on the lane.
Figure 8:
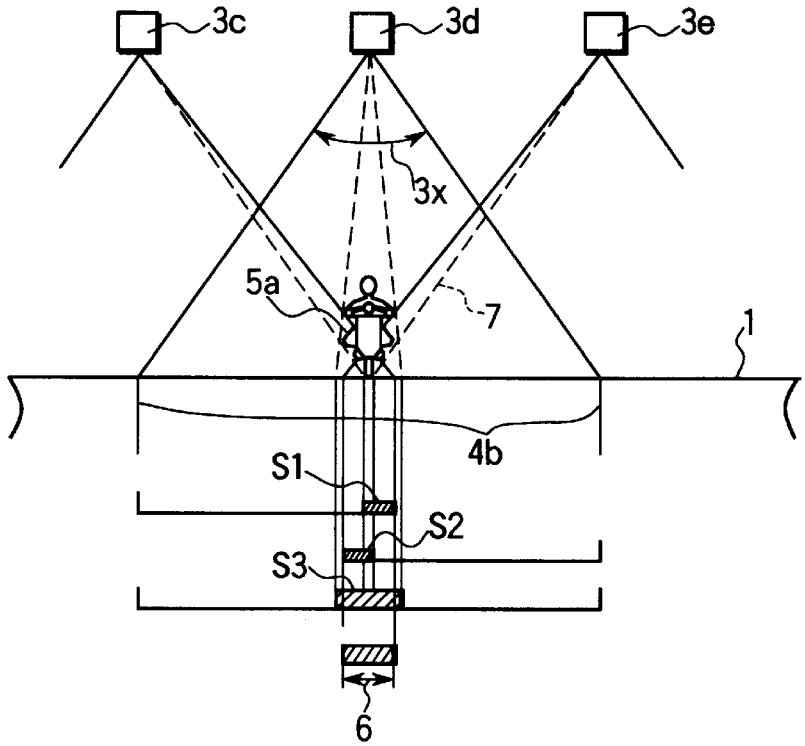
FIG. 8 is a diagram explaining how the system of FIG. 4 measure the width of a motorcycle traveling on a lane of a toll road.

Assume a motor cycle 5*a* travels along the center line of the second lane 4*b*, entering the overlapping parts of the view fields of the line sensors 3*c*, 3*d* and 3*e*, as is illustrated in FIG. 8. In this case, the video signal generated by the optical line sensor 3*d* has a signal differing section, i.e. region of the above binary signal "1", S3. The section S3 represents a width greater than the width of the motor cycle 5*a*. This is because the line sensor 3*d* is located right above the motor cycle 5*a*. Meanwhile, the video signals generated by the line sensors 3*c* and 3*e* have signal differing sections, i.e. regions of the above binary signal "1", S1 and S2 shown in FIG. 8. As comparison between FIG. 8 and FIG. 3 may reveal, the sections S1 and S2 are greater than the sections S1 and S2 of the signals generated in the conventional vehicle-detecting system. This is because the view fields 3*x* of the line sensors 3*c* and 3*e* overlap that of the line sensor 3*d* by the width of the motor cycle 5*a* on the surface of the toll road 1. On the road surface, the right edge of the view field of the sensor 3*c* and the left edge of the view field of the sensor 3*e* are almost aligned with the right and left sides of the motor cycle 5*a*, respectively.

Hence, when the signal-processing section 21 obtains a logical sum of video signals of line sensor 3*c* and 3*d*, there will be detected a region of "1" which has a width corresponding to the width of the motor cycle 5*a* and which momentarily exists in the view fields of the optical line sensors 3*c* and 3*e*.

Then, a logical product of the logical sums obtained in Steps A5 and A6 is obtained (Step A7). As a result, the width 6 and position of the vehicle (i.e., motor cycle 5*a*) can be accurately measured by the result of step A7.

As shown in FIG. 4, the line sensors 3*b*, 3*d* and 3*f* are spaced from the line sensors 3*a*, 3*c*, 3*e* and 3*g* by a distance d, by means of the supports 9*a*, 9*b* and 9*c*. Therefore, that part of the video signal which represents a fallen leaf, trash or the like lying in only one side of the field of above adjacent groups of the sensors will be canceled out by obtaining the logical product of the logical sums acquired in Steps A5 and A6. Thus, the vehicle will be detected with accuracy.

The distance d may be much shorter than the length of the vehicle 5 or the motor cycle 5*a*. Then, the vehicle or motor cycle passing under the gantry 2 will exist, though momentarily, in the view fields of any two adjacent line sensors (e.g., sensors 3*a* and 3*b*, sensors 3*b* and 3*c*, and so on). The video signals generated by the two adjacent line sensors will not be canceled when the logical product of the logical sums acquired in Steps A5 and A6 is obtained.

If no region of "1" is detected as the result of logical calculation in the above Step A7, it is determined that no vehicles are traveling on the lane 4*a*, 4*b* or 4*c* (Step 8). If this case, i.e. NO in Step A8, the operation goes to Step A9. In Step A9 the reference signals are updated (Step A9). The operation then returns to Step A2.

If YES in Step A8, that is, if a region of "1" is detected, it is determined that a vehicle may be traveling under the line sensors or something may spread over the road 1. In this case, the operation goes to Step A10. In Step A10, signals of the photoelectric sensor apparatus 8 are checked. More specifically, if all photo-detector elements 31*a*, 31*b*, 31*c*, 31*d*, 31*e*, 31*f* and 31*g* receive the light beams 8*x*, it is determined nothing exists under the line sensors to intercept the light beams 8*x*. If one of photo-detector elements 31*a*, 31*b*, 31*c*, 31*d*, 31*e*, 31*f* and 31*g* do not receive the light beams 8*x*, it is determined a vehicle 5 exits under the line sensors, intercepting at least one light beams 8*x* (Step A10).

If NO in Step A10, that is, if the photoelectric sensor apparatus 8 detects no vehicle, the operation goes to Step A11. In Step A11, it is determined that the region of "1" detected by the line sensors 3*a* to 3*g* is something fallen and spreading on the toll road 1, and the reference signals are updated. The operation then returns to Step A2.

If YES in Step A10, that is, if the photoelectric sensor apparatus 8 detects a vehicle 5, the operation goes to Step A12. In Step A12, the signal-processing section 21 supplies a signal indicating the entry of the vehicle 5, to the ticket-issuing machine 22 installed at the tollgate. In this case, the reference signals are not updated. If the reference signals are updated, there will arise the possibility that a vehicle may not be detected in the subsequent processing of video signals.

Upon receipt the signal from the signal-processing section 21, the ticket-issuing machine 22 issues a ticket to the driver of the vehicle 5 detected in Step A10. The vehicle 5 can therefore pass through the tollgate.

Thus, any vehicle that travels under the gantry 2 can be detected as a solid body having a width, length and height which are greater than the values determined by the positions of the optical line sensors 3*a* to 3*g* and the positions of the photoelectric sensor apparatus 8, in detail, photo-projector and detector elements 30*a* to 30*g* and 31*a* to 31*g*. Even a vehicle having a small width, such as a motor cycle, can be detected, and its width can be accurately measured. If small things such as a fallen leaf or trash happen to be on the road 1, they would not be detected as vehicles. Further, sand or earth spreading, covering an area on the road 1, would not be detected as a vehicle. The vehicle-detecting system can operate reliably, detecting vehicle traveling under the gantry 2 with high accuracy.

As has been described, the view field 3*x* of each line sensor overlaps that of either adjacent line sensor by the sum of half the view filed 3*x* and the width of a motor cycle, on the surface of the toll road 1. Hence, when a narrow vehicle such as a motor cycle passes right below a line sensor, entering the overlapping parts of the view fields of the two immediately adjacent line sensors, the adjacent line sensors generate video signals which have sufficiently wide signal differing sections. The system can accurately and reliably determine the position and width of the vehicle, from a logical product of the three video signals which are generated by, respectively, the line sensor located right above the vehicle, the line sensor located at an upper-left position, and the line sensor located at an upper-right position.

Moreover, since the line sensors 3*b*, 3*d* and 3*f* are positioned in front of the line sensors 3*a*, 3*c*, 3*e* and 3*g* and spaced therefrom by the distance d, anything shorter than the distance d is never detected as a vehicle. The system would not detect a small thing like trash as a vehicle at all.

As indicated above, the light beams which the photo-projector elements emit toward the photo-detector elements intersect with the optical axes of the optical line sensors. Comprised of the photo-projector 8*a* with plurality of photo-projector elements and photo-detector 8*b* with plurality of photo-detector elements, the photoelectric sensors apparatus 8 can detect the height of any object that is found to be a vehicle by means of the optical line sensors. If the height is less than a motor cycle or a car, that object is determined to be a thing fallen onto the road, such as sand or earth. This serves to increase the operating reliability of the vehicle-detecting system.

As described above, the present invention can provide a vehicle-detecting system which can detect an solid object as a vehicle if the object has a width, length and height, all greater than the values determined by the positions of the optical line sensors and the positions of the photoelectric sensor apparatus, i.e. photo-projector elements and photo-detector elements, and which can therefore detect vehicles with high accuracy and reliability.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A system for optically detecting vehicles traveling a road having a plurality lanes, said system comprising:

a gantry provide at the road so as to straddle the plurality lanes;

a plurality of optical line sensors provided on said gantry, for getting linear images of a surface of the road, said optical line sensors arranged in two rows and in a staggered pattern such that each has a view field overlapping the view field of either adjacent optical line sensor by the sum of half the view field and a width of a motor cycle the optical line sensors having an optical axis;

photoelectric sensor apparatus consisting of photo-projector elements and photo-detector elements, and having optical axes which are parallel to each other and are substantially located in the position of the view fields of said optical line sensors; and a signal-processing section for detecting a vehicle traveling under said gantry in accordance with output signals of said optical line sensors and output signals of said photoelectric sensor apparatus, by using reference signals which said optical line sensors generate when no vehicles travel under them;

wherein the optical axis of the optical line sensors and the optical axes of the photoelectric sensor apparatus intersects with each other.

2. A system according to claim 1, wherein said signal-processing section includes means for converting a correlation between the output signal of each optical line sensor and the corresponding reference signal into a binary signal, obtaining a logical sum of the binary signals pertaining to the optical line sensors of one row and a logical sum of the binary signals pertaining to the optical line sensors of the other row, obtaining a logical produce of the two logical sums, and determining, from the logical product, whether a vehicle is traveling under said gantry.

3. A system according to claim 1, wherein said signal-processing section includes means for converting a correlation between the output signal of each optical line sensor and the corresponding reference signal into a binary signal, obtaining a logical sum of the binary signals pertaining to the optical line sensors of one row and a logical sum of the binary signals pertaining to the optical line sensors of the other row, for obtaining a logical produce of the two logical sums, thereby generating a vehicle detection signal, and detecting a vehicle on the basis of the vehicle detection signal and vehicle detection signals generated by said photoelectric sensors.

4. A system according to claim 1, wherein said signal-processing section includes means for updating the reference signals to the output signals of said optical line sensors, which indicate that no vehicles are traveling under said gantry.

5. A system for optically detecting vehicles traveling a road having a plurality lanes, said system comprising:

a gantry provide at the road so as to straddle the plurality lanes;

a plurality of optical line sensors provided on said gantry, for getting linear images of a surface of the road, said optical line sensors arranged in two rows and in a staggered pattern such that each has a view field overlapping the view field of either adjacent optical line sensor by the sum of half the view field and a width of a motor cycle;

photoelectric sensor apparatus consisting of photo-projector elements and photo-detector elements, and having optical axes which are parallel to each other and are substantially located in the position of the view fields of said optical line sensors;

a signal-processing section for detecting a vehicle traveling under said gantry in accordance with output signals of said optical line sensors and output signals of said photoelectric sensor apparatus, by using reference signals which said optical line sensors generate when no vehicles travel under them; and a ticket-issuing machine for issuing a toll ticket when said signal-processing section detects a vehicle traveling under said gantry.

* * * * *